US009017107B2

(12) United States Patent
Eckart et al.

(10) Patent No.: US 9,017,107 B2
(45) **Date of Patent: *Apr. 28, 2015**

(54) INSERTION-TYPE CONNECTOR HAVING A CONTACT-MAKING MEMBER

(75) Inventors: Christian Eckart, Vachendorf (DE); Christian Maier, Griesstätt (DE); Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 52 days.

This patent is subject to a terminal disclaimer.

(21) Appl. No.: 14/111,552

(22) PCT Filed: Jan. 30, 2012

(86) PCT No.: PCT/EP2012/000399

§ 371 (c)(1), (2), (4) Date: Nov. 20, 2013

(87) PCT Pub. No.: WO2012/139676

PCT Pub. Date: Oct. 18, 2012

(65) Prior Publication Data

US 2014/0170874 A1 Jun. 19, 2014

(30) Foreign Application Priority Data

Apr. 14, 2011 (DE) ..... 20 2011 005 271 U

(51) Int. Cl.
*H01R 13/24* (2006.01)
*H01R 13/44* (2006.01)
*H01R 13/453* (2006.01)

(52) U.S. Cl.
CPC ..... *H01R 13/44* (2013.01); *H01R 13/2421* (2013.01); *H01R 13/4538* (2013.01)

(58) Field of Classification Search
CPC ..... H01R 13/2421; H01R 23/722
USPC ..... 439/700, 66, 146, 500
See application file for complete search history.

(56) References Cited

U.S. PATENT DOCUMENTS

| | | | | |
|---|---|---|---|---|
| 4,904,213 | A * | 2/1990 | Hock et al. | 439/824 |
| 5,151,040 | A * | 9/1992 | Tanaka | 439/73 |
| 5,641,315 | A * | 6/1997 | Swart et al. | 439/824 |
| 6,835,903 | B1 | 12/2004 | Liu et al. | |
| 6,909,056 | B2 * | 6/2005 | Vinther | 174/260 |

(Continued)

FOREIGN PATENT DOCUMENTS

| | | | |
|---|---|---|---|
| DE | 10 2008 029505 | A1 | 12/2009 |
| DE | 20 2009 017314 | U1 | 3/2010 |
| DE | 20 2010 010827 | U1 | 10/2010 |

*Primary Examiner* — Phuongchi T Nguyen

(74) *Attorney, Agent, or Firm* — DeLio, Peterson & Curcio, LLC; Robert Curcio

(57) ABSTRACT

A plug-type connector for producing at least one electrical contact, in particular charging plug or heavy-duty plug, having a housing and at least one first contact element arranged in the housing, wherein the housing has a plugging-side end, which is designed for plugging connection to a complementary plug-type connector, and wherein the at least one first contact element has a free end, which faces the plugging-side end, wherein at least one first contact element of the plug-type connector and at least one part of the housing are movable relative to one another between a first position, in which the first contact element is withdrawn into the housing, and a second position, in which the free end of the first contact element is exposed.

18 Claims, 8 Drawing Sheets

(56) References Cited

U.S. PATENT DOCUMENTS 6,932,620 B2 * 8/2005 Ishiguro et al. ..... 439/66
7,857,639 B1 12/2010 Chang
7,869,896 B2 * 1/2011 Yamada et al. ..... 700/164
8,105,117 B2 * 1/2012 Ikegami et al. ..... 439/700
2005/0153588 A1 7/2005 Liao

* cited by examiner

INSERTION-TYPE CONNECTOR HAVING A CONTACT-MAKING MEMBER

BACKGROUND OF THE INVENTION

1. Field of the Invention

The present invention relates to an insertion-type connector for making at least one electrical contact, and in particular to a charging connector or high-current connector, having a housing and having at least one first contact-making member arranged in the housing, the housing having an insertion end which is designed for connection by insertion to a complementary insertion-type connector and the at least one first contact-making member having a free end which is adjacent the insertion end, at least one first contact-making member of the insertion-type connector and at least one part of the housing being movable relative to one another between a first position in which the first contact-making member is drawn back into the housing and a second position in which the free end of the first contact-making member is exposed, there being provided at least one second contact-making member which is arranged in a fixed position relative to the part of the housing and to the first contact-making member, the second contact-making member being electrically connected to the movable first contact-making member via an electrical sliding contact.

2. Description of Related Art

A high-current insertion-type connector for transmitting electrical currents is known from DE 20 2010 010 827 U1. This has a housing of electrically conductive material which is designed for mechanical and electrical connection to a cable and which has an open end for the insertion of a mating insertion-type connector made of an electrically conductive material. Also provided is a contact-making member, which is so arranged and formed in the housing that it makes electrical contact with a contact surface and produces contact-making pressure between the housing and the mating insertion-type connector inserted therein. The contact-making member has at least one annular helical spring.

US 2005/0153588 A1 is the generic document and known therefrom is an electrical adapting connector in which a first electrical connector and a second electrical connector are arranged to be displaceable in a housing in such a way that either the first electrical connector or the second electrical connector, as desired, projects from the housing. A linking mechanism ensures that there is relative movement relative to one another between the first and second electrical connectors.

SUMMARY OF THE INVENTION

Bearing in mind the problems and deficiencies of the prior art, it is therefore an object of the present invention to design an insertion-type connector of the above-mentioned kind in such a way that safety is improved for an operator using this connector, thus making the insertion-type connector suitable even for applications in the field of high electrical currents and voltages.

This object is achieved in accordance with the invention by an insertion-type connector of the above-mentioned kind which has the features characterized in the claims.

The above and other objects, which will be apparent to those skilled in the art, are achieved in the present invention which is directed to an insertion-type connector for making at least one electrical contact comprising: a housing having an insertion end which is designed for connection by insertion to a complementary insertion-type connector; at least one first contact-making member arranged in the housing, the at least one first contact-making member having a free end adjacent the insertion end, the at least one first contact-making member of the insertion-type connector and at least one part of the housing being movable relative to one another between a first position in which the first contact-making member is drawn back into the housing and a second position in which the free end of the first contact-making member is exposed; at least one second contact-making member arranged in a fixed position relative to the part of the housing and to the first contact-making member, the second contact-making member being electrically connected to the first contact-making member via an electrical sliding contact, such that the sliding contact includes at least one helical spring which makes electrical contact with the first and second contact-making members by opposite radial outer sides of the helix by contact-making pressure at a contact surface. The at least one helical spring may be fastened to the first contact-making member in a fixed position.

The at least one first contact-making member may make electrical contact with a complementary contact-making member in the complementary insertion-type connector when the insertion-type connector is inserted in the complementary insertion-type connector.

The insertion-type connector may take the form of a male connector and at least one first contact-making member takes the form of a contact-making pin.

The first contact-making member, or the part of the housing, or both are movable in a direction parallel to the direction of insertion of the insertion-type connector in the complementary insertion-type connector.

The housing may include a cover comprising an electrically insulating material at the insertion end, the at least one first contact-making member being arranged within a space defined by the housing and the cover in the first position and extending to project through the cover and out thereof in the second position. The cover and the housing may be integrally formed.

The insertion-type connector may include an end-cap at the free end of at least one first contact-making member, the end-cap made of an electrically insulating material completely covering the free end.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
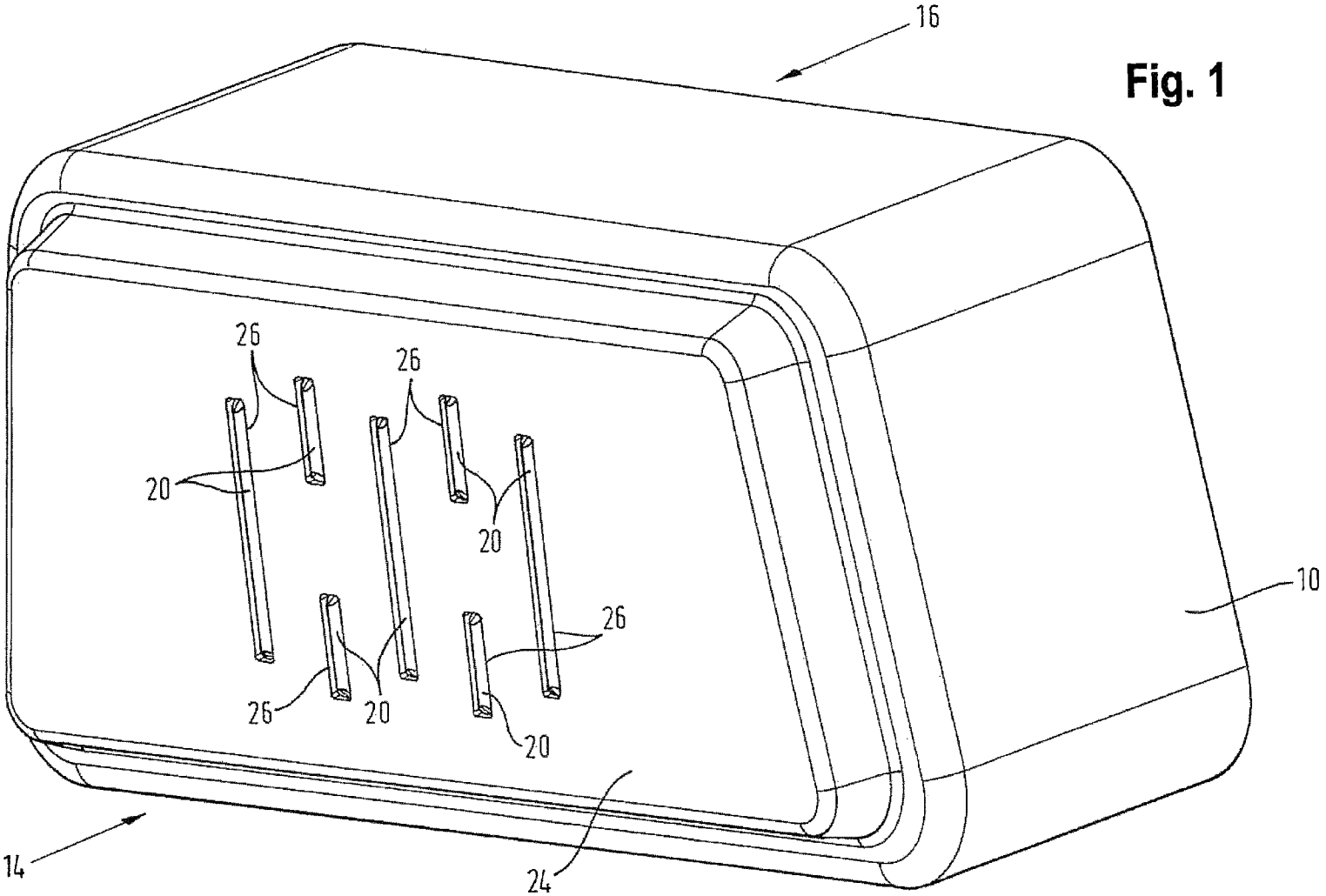
FIG. 1 is a perspective view of a preferred embodiment of an insertion-type connector according to the invention in a state where the contact-making members are withdrawn.

In describing the preferred embodiment of the present invention, reference will be made herein to FIGS. 1-8 of the drawings in which like numerals refer to like features of the invention.

In an insertion-type connector of the above-mentioned kind, provision is made in accordance with the invention for the sliding contact to comprise at least one helical spring which makes electrical contact with the first and second contact-making members by opposite radial outer sides of turns of the helix, so doing by, in each case, contact-making pressure at a contact surface.

This has the advantage that protection from electric shock can be achieved in such a way that the at least one first contact-making member cannot be unintentionally touched by an operator when the insertion-type connector is not inserted in a complementary insertion-type connector. This makes the insertion-type connector suitable even for applications where a voltage is applied to the first contact-making member or members even in the un-inserted state. At the same time, decoupling is achieved of the movement of the first contact-making member or members from a cable end of the insertion-type connector to which an electrical cable is fastened electrically and mechanically. The good electrical contact is not adversely affected by the relative movement between the first and second contact-making members.

To make at least one electrical contact, the at least one first contact-making member is designed to make electrical contact with a complementary contact-making member in the complementary insertion-type connector when the insertion-type connector is inserted in the complementary insertion-type connector.

For connection to a coupler or female insertion-type connector, the insertion-type connector takes the form of a male connector and at least one first contact-making member takes the form of a contact-making pin.

Connection by insertion in a straight line is achieved by making the first contact-making member and/or the part of the housing movable in a direction parallel to the direction of insertion of the insertion-type connector in the complementary insertion-type connector.

Particularly good protection of the first contact-making member or members against causing an electrical shock is achieved by giving the housing a cover of an electrically insulating material at the insertion end, the at least one first contact-making member being arranged within a space defined by the housing and the cover in the first position and extending to project through the cover and out thereof in the second position.

Protection against electric shock which is particularly reliable and certain to work is achieved by forming the cover and the housing in one piece with one another.

A further improvement in the protection against electric shock is achieved by arranging, at the free end of at least one first contact-making member, an end-cap made of an electrically insulating material which completely covers the free end.

An improvement in the certainty with which the making of electrical contact between the first and second contact-making members works is achieved by fastening the at least one helical spring to the first contact-making member in a fixed position.

Figure 5:
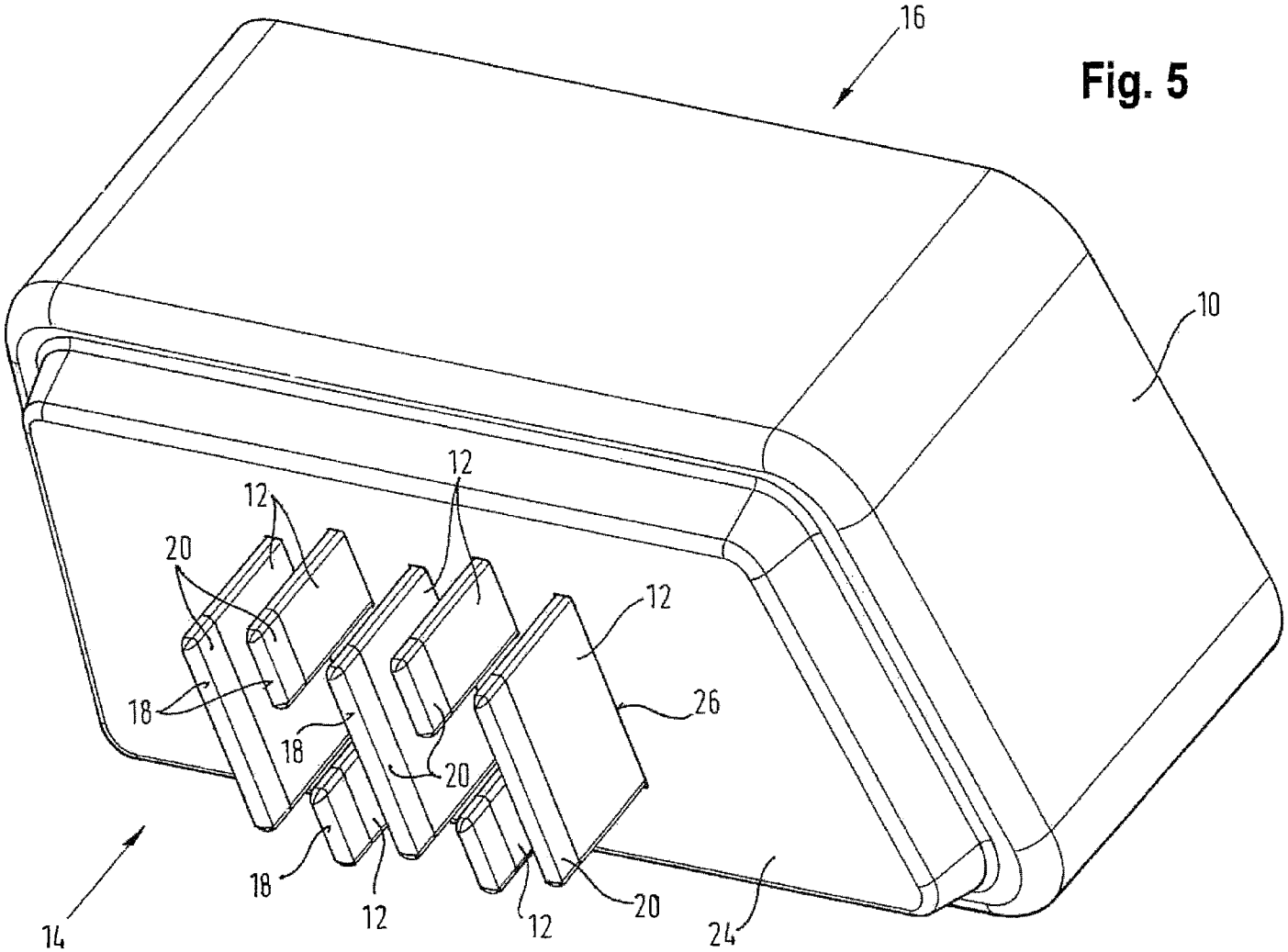
FIG. 5 is a perspective view of the insertion-type connector shown in FIG. 1 in a state where the contact-making members are fully extended.
Figure 6:
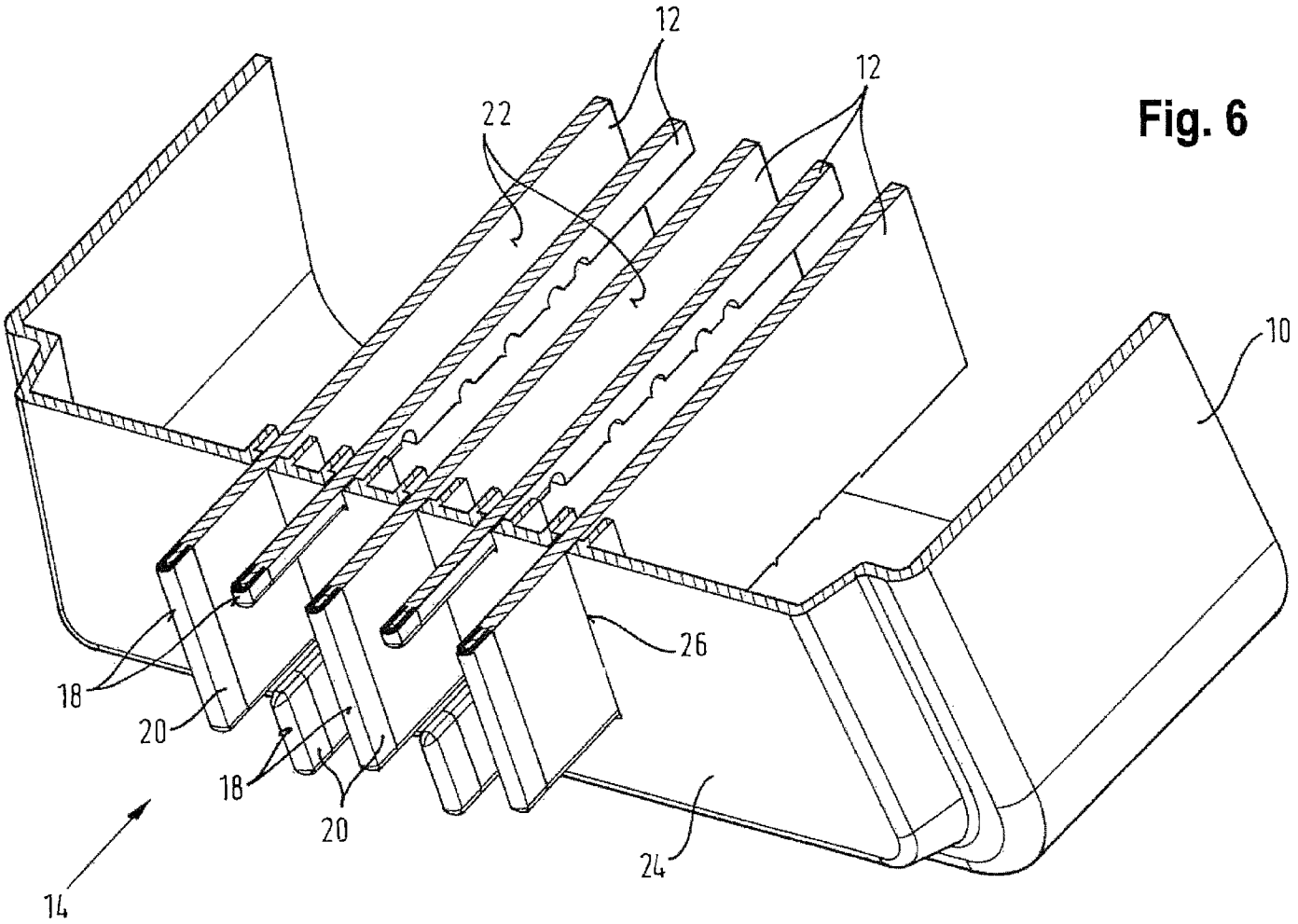
FIG. 6 is a partly broken-away perspective view of the insertion-type connector shown in FIG. 1 in a state where the contact-making members are fully extended.
Figure 7:
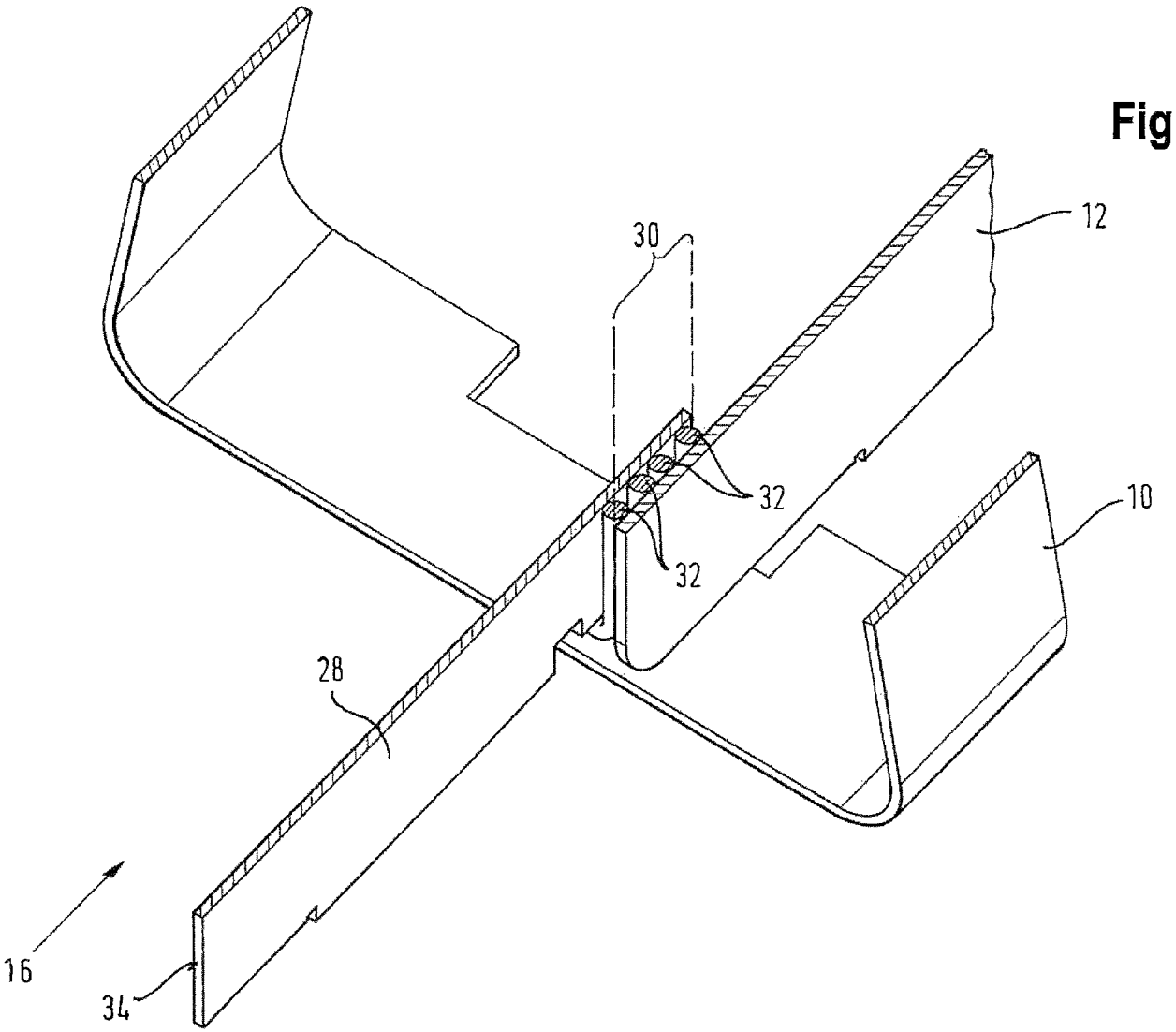
FIG. 7 is a broken-away perspective view of the cable end of the insertion-type connector shown in FIG. 1 in a state where a contact-making member is extended.
Figure 8:
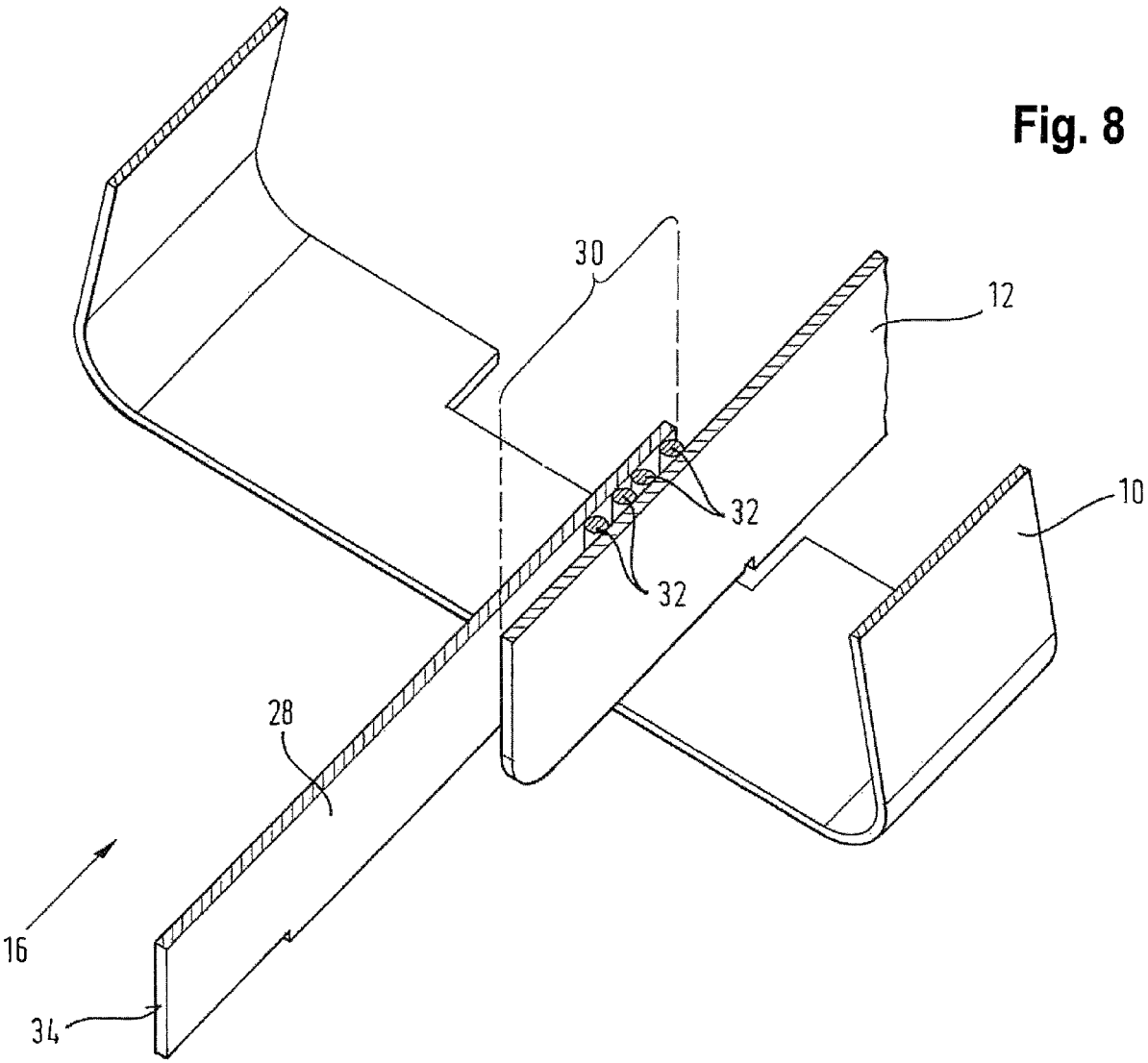
FIG. 8 is a broken-away perspective view of the cable end of the insertion-type connector shown in FIG. 1 in a state where a contact-making member is withdrawn.

The preferred embodiment of insertion-type connector according to the invention which is shown in FIGS. 1 to 8 comprises a housing 10 made of an electrically insulating material in which seven first contact-making members 12 are arranged. For reasons of greater clarity, the way in which the first contact-making members 12 are mounted and held for movement relative to the housing 10 is not shown in any of the drawings. The first contact-making members 12 are of a blade-like form and are arranged substantially parallel to one another, which means that respective wide sides 22 of adjacent first contact-making members 12 are adjacent one another. The housing 10 has an insertion end 14 for connection by insertion to a complementary insertion-type connector (not shown) and a cable end 16 for connection electrically and mechanically to an electrically conductive cable (not shown). In FIGS. 1 to 6 the insertion-type connector is shown up to the insertion end 14 and the cable end 16 is cut off. In FIGS. 7 and 8 the cable end 16 of the housing 10 and its insertion end 14 are cut off.

The first contact-making members 12 each have a free end 18 which is adjacent the insertion end 14. Mounted in a leading position on each free end 18 is an end-cap 20 made of an electrically insulating material. Otherwise the first contact-making members 12 are made of an electrically conductive material and are intended to make electrical contact with corresponding contact-making members in a complementary insertion-type connector (not shown) which can be plugged together with the insertion-type connector according to the invention.

At the insertion end 14, the housing 10 has a cover 24 which has apertures 26 which are so designed and arranged that one first contact-making member 12 fits through each aperture 26.

Figure 2:
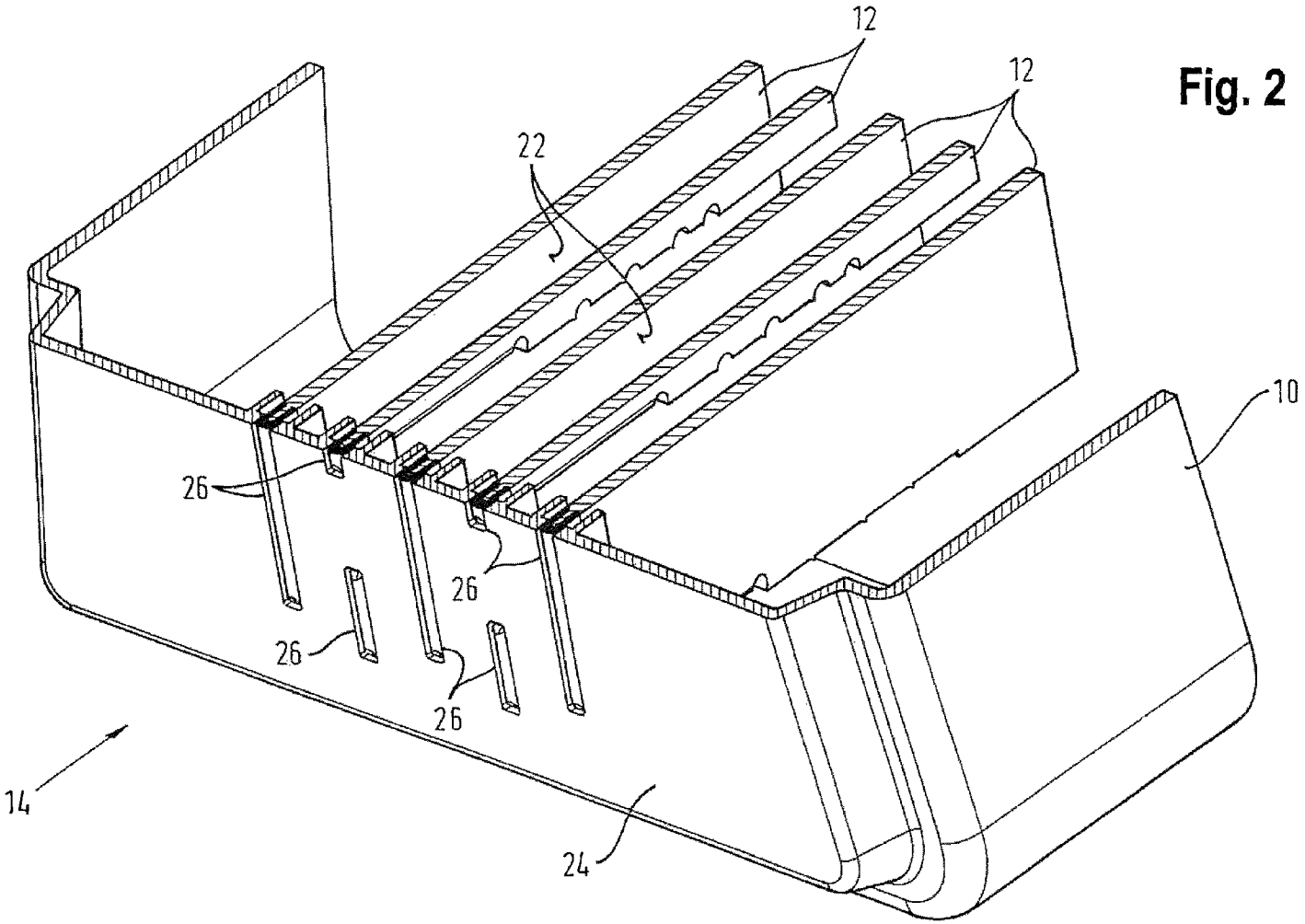
FIG. 2 is a partly broken-away perspective view of the insertion-type connector shown in FIG. 1 in a state where the contact-making members are withdrawn.
Figure 3:
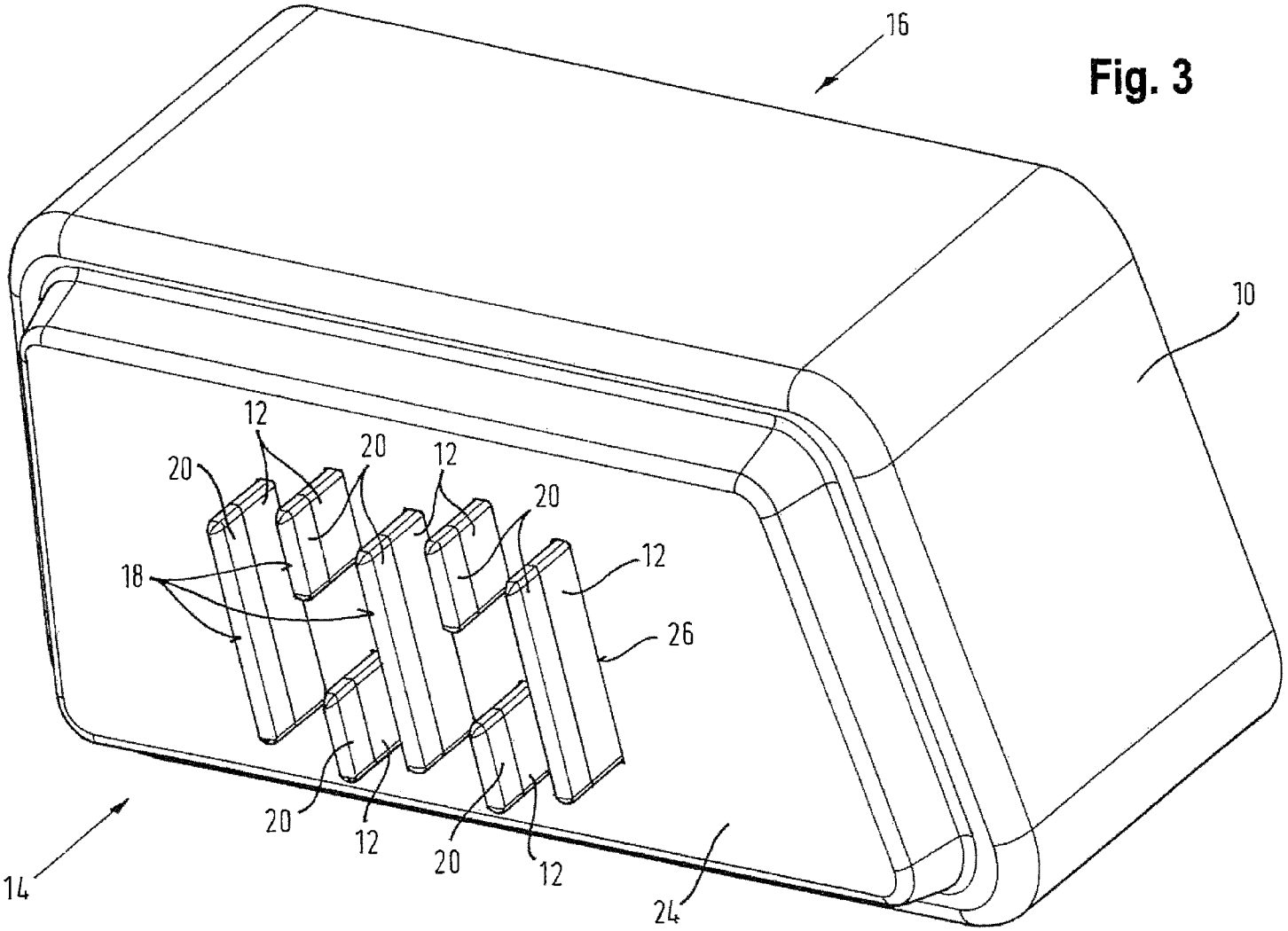
FIG. 3 is a perspective view of the insertion-type connector shown in FIG. 1 in a state where the contact-making members are partly extended.
Figure 4:
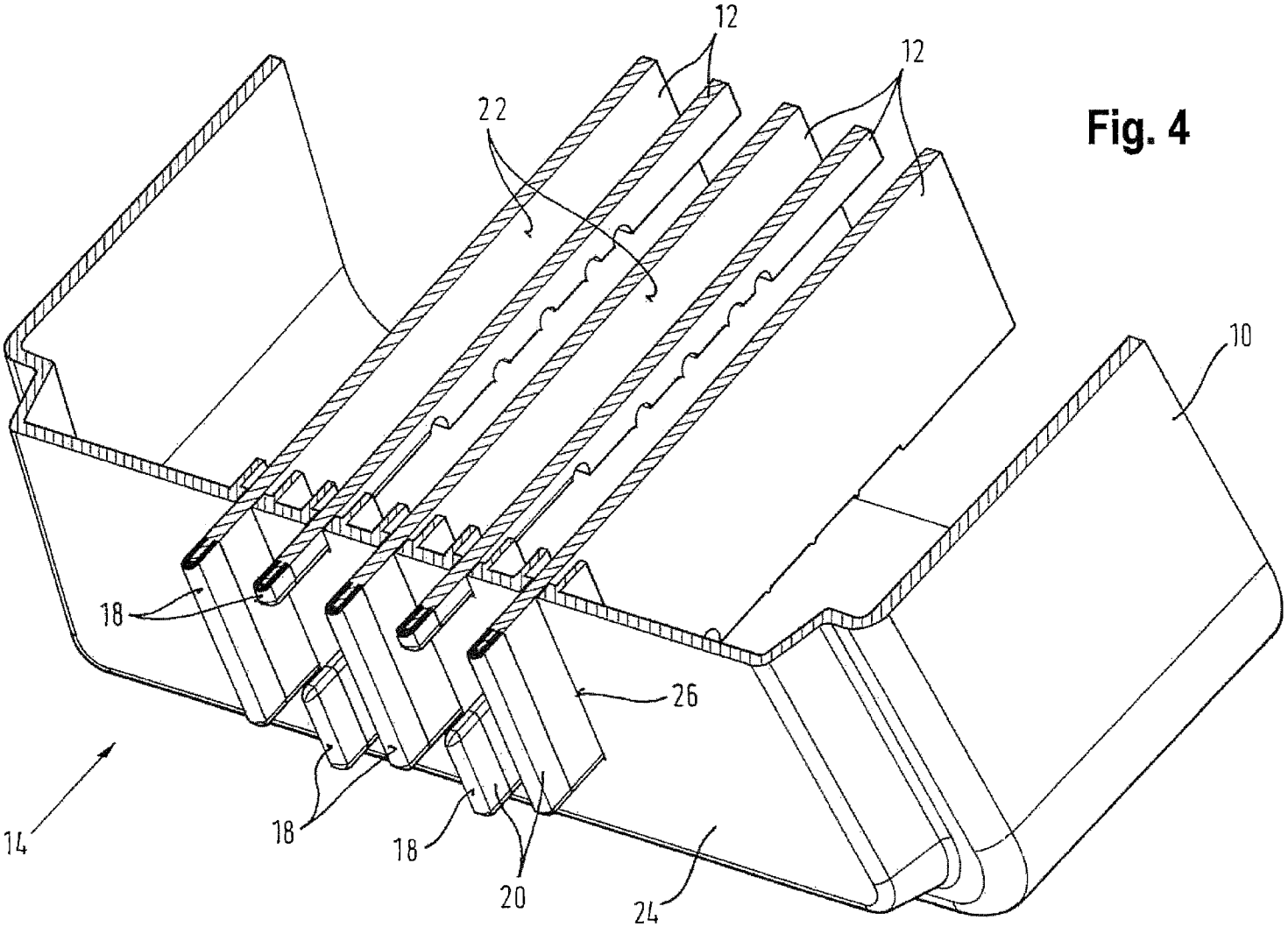
FIG. 4 is a partly broken-away perspective view of the insertion-type connector shown in FIG. 1 in a state where the contact-making members are partly extended.

The first contact-making members 12 are movably arranged relative to the housing 10 to be movable between a first position as shown in FIGS. 1 and 2 and a second position as shown in FIGS. 5 and 6. FIGS. 3 and 4 show an intermediate position of the first contact-making members 12 between the first and second positions. A mechanism for moving the first contact-making members 12 has not been shown in the drawings for reasons of greater clarity. In the first position, the first contact-making members 12 are drawn back into a space bounded by the housing 10 and the cover 24. In the second position, the first contact-making members 12 are slid out of the housing 10 through the apertures 26 and thus project beyond the cover 24 and the housing 10 in the direction towards the insertion end 14.

In the first position, there is thus protection against unwanted electric shock of an operator by the first contact-making members 12 when the insertion-type connector according to the invention is not inserted in a complementary insertion-type connector and the insertion end 14 is thus freely accessible. At the insertion end it is only the electrically insulating cover 24 and electrically insulated housing 10 together with the end-caps 20 which are exposed. A voltage can thus be applied to the first contact-making members 12 even when the insertion-type connector according to the invention is in the unplugged state without this creating any risk to an operator due to unwanted contact with the first contact-making members 12 at an electrically conductive point.

Once the insertion-type connector according to the invention has been plugged together with a complementary insertion-type connector, the first contact-making members 12 are extended through the cover 24 from the first position to the second position, the first contact-making members 12 thus making contact electrically with corresponding contact-making members in the complementary insertion-type connector. Conversely, before the insertion-type connector according to the invention and the complementary insertion-type connector are pulled apart again, the first contact-making members 12 are pulled back again from the second position to the first position. There is preferably provided an appropriate first securing mechanism which only permits the first contact-making members 12 to move from the first position to the second position if the insertion-type connector according to the invention is fully inserted in the complementary insertion-type connector. It is also preferable for a second securing mechanism to be provided which prevents the insertion-type connector according to the invention and the complementary insertion-type connector to be unplugged from one another for as long as the first contact-making members are not in the first position.

At its cable end 16, the insertion-type connector according to the invention is connected to an electrically conductive cable. To decouple the movement of the first contact-making members 12 from the cable end 16, or in other words from the cable, there is provided for each movable first contact-making member 12 a second contact-making member 28 which is fixed relative to the housing 10, as shown in FIGS. 7 and 8. For reasons of clearer clarity, only one pair of first and second contact-making members 12, 28 is shown in FIGS. 7 and 8.

The second contact-making members 28 are of a blade-like form and the first and second contact-making members 12, 28 comprising each pair are arranged parallel to one another in such a way that respective wide sides of the first and second contact-making members 12, 28 are adjacent one another. Also, at least one helical spring 32 made of an electrically conductive and resilient material is arranged in a region of overlap 30 between the blade-like contact-making members 12, 28 which form a pair of first and second contact-making members 12, 28. The diameter of the helical spring 32 in the region of overlap 30 and a distance, in this region 30, between the blade-like contact-making members 12, 28, i.e. between the wide sides 22 of a pair of first and second contact-making members 12, 28, are so selected that respective turns of the helix of the helical spring 32 rest against a first contact-making member 12 by a first radial outer side and against the second contact-making member 28 by a second outer side opposite from the first radial outer side, thus producing between the turns of the helical spring 32 and the respective contact-making members 12, 28, points where electrical contact is made with a contact surface by a contact-making pressure. The contact-making pressure sets itself by virtue of the fact that the turns of the helical spring 32 are deflected from respective rest positions relative to a longitudinal axis of the helical spring 32 or in other words are tilted relative to the longitudinal axis of the helical spring 32. This is achieved by making the distance between the blade-like contact-making members 12, 28 forming a pair of first and second contact-making members 12, 28 smaller than the outside diameter of the helical spring 32.

The helical spring 32 is fastened to the first contact-making member 12, which means that the helical spring 32 moves with the first contact-making member 12. When there is a movement of the first contact-making member 12, the turns of the helical spring 32 thus rub along the second contact-making member 28 and thereby maintain an adequate electrical connection between the two contact-making members 12, 28.

The second contact-making members 28 each have a free end which has a leading end-face 34, this free end being adjacent the cable end 16 of the insertion-type connector according to the invention. The leading end-face 34 is used for example to make electrical contact with a core or electrical conductor of a cable which is to be connected to the insertion-type connector according to the invention.

The helical spring 32 is preferably of an annular form and defines an area of space within its annulus. At the point in question and at its own boundaries relative to the helical spring 32, this area is aligned parallel to the longitudinal axis of the helical spring 32. Because of its annular form, in principle the helical spring 32 creates in space a torus which has two opposing axial ends. In accordance with the invention, the helical spring 32 is so arranged in the region of overlap 30 between the two contact-making members 12, 28 that the helical spring 32 butts against the first contact-making member 12 by turns at one axial end and against the second contact-making member 28 by turns at the other, opposite, axial end, as can be seen from FIGS. 7 and 8. In other words, neither of the contact-making members 12, 28 fits through the area in the annulus of the annular helical spring 32 and instead the making of electrical contact between the helical spring 32 and the contact-making members 12, 28 takes place at axial ends of the annular helical spring 32. Because of this the helical spring 32 can be securely fastened to the first contact-making member 12 and is secured against slipping or twisting if there is a movement of the first contact-making member 12 relative to the second contact-making member 28. The area enclosed within the annulus of the helical spring 32 preferably fits partly round the first contact-making member 12. This provides additional assistance with the fixing of the helical spring 32 not only at the location of the first contact-making member 12 but also against any deformation of the annular form of the helical spring 32 between the contact-making members 12, 28.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connector for making at least one electrical contact comprising:

a housing having an insertion end which is designed for connection by insertion to a complementary insertion-type connector;

at least one first contact-making member arranged in the housing, the at least one first contact-making member having a free end adjacent the insertion end, the at least one first contact-making member of the insertion-type connector and at least one part of the housing being movable relative to one another between a first position in which the first contact-making member is drawn back into the housing and a second position in which the free end of the first contact-making member is exposed;

at least one second contact-making member arranged in a fixed position relative to the part of the housing and to the first contact-making member, the second contact-making member being electrically connected to the first contact-making member via an electrical sliding contact, such that the sliding contact includes at least one helical spring which makes electrical contact with the first and second contact-making members by opposite radial outer sides of the helix by contact-making pressure at a contact surface.

2. The insertion-type connector of claim 1, wherein the insertion-type connector takes the form of a male connector and at least one first contact-making member takes the form of a contact-making pin.

3. The insertion-type connector of claim 1 including the at least one helical spring fastened to the first contact-making member in a fixed position.

4. The insertion-type connector of claim 1 wherein said connector is adapted for charging or high current applications.

5. The insertion-type connector of claim 1, wherein the first contact-making member, or the part of the housing, or both being movable in a direction parallel to the direction of insertion of the insertion-type connector in the complementary insertion-type connector.

6. The insertion-type connector of claim 5, wherein the housing includes a cover comprising an electrically insulating material at the insertion end, the at least one first contact-making member being arranged within a space defined by the housing and the cover in the first position and extending to project through the cover and out thereof in the second position.

7. The insertion-type connector of claim 1 including an end-cap at the free end of at least one first contact-making member, said end-cap made of an electrically insulating material completely covering the free end.

8. The insertion-type connector of claim 7 including the at least one helical spring fastened to the first contact-making member in a fixed position.

9. The insertion-type connector of claim 1, wherein the housing includes a cover comprising an electrically insulating material at the insertion end, the at least one first contact-making member being arranged within a space defined by the housing and the cover in the first position and extending to project through the cover and out thereof in the second position.

10. The insertion-type connector of claim 9, wherein the cover and the housing are integrally formed.

11. The insertion-type connector of claim 10 including an end-cap at the free end of at least one first contact-making member, said end-cap made of an electrically insulating material completely covering the free end.

12. The insertion-type connector of claim 1, wherein the at least one first contact-making member makes electrical contact with a complementary contact-making member in the complementary insertion-type connector when the insertion-type connector is inserted in the complementary insertion-type connector.

13. The insertion-type connector of claim 12, wherein the insertion-type connector takes the form of a male connector and at least one first contact-making member takes the form of a contact-making pin.

14. The insertion-type connector of claim 12, wherein the first contact-making member, or the part of the housing, or both being movable in a direction parallel to the direction of insertion of the insertion-type connector in the complementary insertion-type connector.

15. The insertion-type connector of claim 14, wherein the housing includes a cover comprising an electrically insulating material at the insertion end, the at least one first contact-making member being arranged within a space defined by the housing and the cover in the first position and extending to project through the cover and out thereof in the second position.

16. The insertion-type connector of claim 15, wherein the cover and the housing are integrally formed.

17. The insertion-type connector of claim 16 including an end-cap at the free end of at least one first contact-making member, said end-cap made of an electrically insulating material completely covering the free end.

18. The insertion-type connector of claim 17 including the at least one helical spring fastened to the first contact-making member in a fixed position.

* * * * *